United States Patent [19]

Morrison

[11] Patent Number: 4,676,691

[45] Date of Patent: Jun. 30, 1987

[54] DUAL ROTARY TROWEL

[76] Inventor: Donald R. Morrison, 6228 Eagle Peak Dr., Charlotte, N.C. 28214

[21] Appl. No.: 901,013

[22] Filed: Aug. 28, 1986

[51] Int. Cl.[4] ..... E01C 19/22

[52] U.S. Cl. ..... 404/112

[58] Field of Search ..... 404/112

[56] References Cited

U.S. PATENT DOCUMENTS

| | | | |
|---|---|---|---|
| 2,277,389 | 3/1942 | Conway | 404/112 |
| 2,351,278 | 6/1944 | Matthews | 404/112 |
| 2,826,971 | 3/1958 | Stevens | 404/112 |
| 2,826,972 | 3/1958 | Stevens | 404/112 |
| 2,887,934 | 5/1959 | Whiteman | 404/112 |
| 2,888,863 | 6/1959 | Eisenbeis | 404/112 |
| 3,062,107 | 11/1962 | Mitchell | 404/112 |
| 3,412,657 | 11/1968 | Colizza et al. | 404/112 |
| 3,936,212 | 2/1976 | Holz, Sr. et al. | 404/112 |
| 4,046,484 | 9/1977 | Holz et al. | 404/112 |
| 4,312,603 | 1/1982 | Whiteman, Jr. | 404/112 |
| 4,320,986 | 3/1982 | Morrison | 404/112 |

*Primary Examiner*—James A. Leppink
*Assistant Examiner*—Matthew Smith
*Attorney, Agent, or Firm*—B. B. Olive

[57] ABSTRACT

A concrete troweling machine is illustrated as having two sets of troweling blades with a mechanism for setting the tilt of individual blades in a rotor assembly and a separate mechanism controlled by the handle position for progressively changing the tilt of individual blades during each rotation of each set of blades to generate blade reactive forces for propelling the machine in selected direction.

11 Claims, 12 Drawing Figures

DUAL ROTARY TROWEL

DESCRIPTION

1. Technical Field

The invention relates to motor-powered trowels for smoothing concrete or cement.

2. Background Art

One of the most popular types of non-riding, motor-powered trowels is the type having only one set of trowel blades as illustrated, for example, in U.S. Pat. No. 2,888,863 or in applicant's later U.S. Pat. No. 4,320,986. For larger jobs, U.S. Pat. No. 2,887,934 illustrates a non-riding, motor-powered trowel having two sets of trowel blades located one behind the other. U.S. Pat. No. 4,046,484, as another example, illustrates a riding type motor-powered trowel having two sets of trowel blades in a side-by-side arrangement. U.S. Pat. No. 3,936,212, in a still further example, illustrates a riding-type, motor-powered trowel having three sets of trowel blades.

A study of the prior art patents related to motor-powered trowels having single, dual or triple sets of trowel blades reveals that the ability to steer the trowel, whatever type it might be, is a primary concern. In a motor-powered trowel having a single set of trowel blades and designed so that the operator walks behind the trowel during operation, the trowel is typically steered to the operator's right or left by raising or lowering the handle to cause the axis of the single set of trowel blades to tilt and the trowel to move to the right or the left. The rotating single set of trowel blades applies a reaction force to the trowel structure which must be compensated for by the operator. Substantial manual effort is thus involved in steering the trowel. In a motor-powered trowel having two sets of trowel blades, it is known to rotate the two sets of trowel blades in overlapping circular areas and in opposite directions to produce opposing reaction forces which assist in manually steering the trowel in any desired direction. Here, it might be noted as background that a non-riding, dual trowel typically works the concrete surface by moving from side to side and moving in the direction of the unworked surface.

U.S. Pat. No. 3,936,212 teaches a lever and linkage arrangement applicable to both triple and double riding trowels for steering by tilting the axes of the trowel rotors in the same direction as seen for example in FIG. 16 of the patent. U.S. Pat. No. 4,046,484 also describes a riding-type, motor-powered trowel with dual sets of blades and with means for tilting the rotor assembly axes with a handle and lever arrangement during steering. A later U.S. Pat. No. 4,312,603 teaches a handle operated steering arrangement for a double trowel in which the axes of rotation of the trowel rotors are tilted in opposite directions to generate blade reactive forces to cause the trowel machine to move along a path of movement extending at a right angle to the axis of the frame structure. Thus, steering as taught by the prior art has been accomplished either by manually tilting the trowel as for example for the small single trowel or by tilting the axes of the rotor assemblies as in the larger walking or riding motor-powered trowels having two or three sets of trowel blades and three, four or five blades per set.

With more specific reference to what is sometimes referred to as the twin, dual or double type of motor-powered trowel, it is noted that the two sets of trowel blades are conventionally driven by a single power source and through a mechanical gear and chain arrangement as in U.S. Pat. No. 2,887,934 or by a belt and pulley arrangement as in U.S. Pat. No. 4,312,603. The resistance to the trowel blades may vary substantially in different areas of a particular concrete floor job site. Thus, if one set of trowel blades in a dual set of trowel blades rotating in opposite directions happens to engage a relatively soft area whereas another set of trowel blades on the same trowel machine happens to simultaneously engage a relatively hard area of concrete, the two sets of blades tend to rotate at different speeds. Thus, operating stresses are placed on whatever type of mechanical mechanism is being employed to connect and drive the two sets of blades. With the foregoing in mind, the present invention has as one of its objects providing means for independently driving each set of two sets of trowel blades in a dual motor-powered trowel with hydraulic motors and in a manner which allows the blades to rotate in opposite directions and in overlapping, intermeshed circles. In the invention trowel machine, the stresses imposed by different areas of concrete are transferred initially to each independent hydraulic drive system for the separate sets of trowel blades but with a gear-like arrangement loosely locking the two sets of trowel blades together to maintain the blades intermeshed.

As another aspect of operating a motor-powered trowel, it is known to be desirable to operate the blades flat for floating and incorporate means for tilting the blades relative to the work surface to vary the blade action, for example, from a finishing action to a floating action or visa versa. U.S. Pat. Nos. 2,351,278 and 3,412,657 teach, for example, mechanical arrangements for adjusting the blade tilt whereas U.S. Pat. Nos. 2,826,971 and 3,062,107, by way of example, illustrate blade-tilting apparatus using hydraulic mechanisms. The ability to vary the blade tilt while the troweling operation continues is thus an important advantage to the operator.

Applicant has previously employed a single trowel blade tilting mechanism in which a vertically-adjustable, horizontal bearing plate bears on rollers mounted on arms at the ends of shafts mounting the blades. Thus, the amount of tilt is uniform for all the blades and is controlled by vertically adjusting the bearing plate. However, prior to the present invention, it was not known to use such a bearing plate-roller arrangement in a manner enabling the tilt of the blades to progressively change during each rotation as an aid to steering a dual trowel.

The ability to absorb shocks brought about by suddenly encountering areas of different resistance or hidden obstructions, e.g., a protruding wet concrete covered pipe, provokes a further need for providing a motor-powered trowel having the ability to absorb shocks and differences in drive forces with minimal damage to the trowel. A hydraulic motor trowel drive, as taught by applicant's prior U.S. Pat. No. 4,320,986, has provided a desirable clutch-like and cushioning effect when the rotor blades unexpectedly hit an object such as a protruding pipe. So far as applicant is aware, it has not been previously known to independently drive two sets of counter-rotating, intermeshed trowel blades with hydraulic motors in a walking-type double trowel in a manner which permits steering with the cushioning effect advantage of the hydraulic drive system. The achieving of such an improved motor-powered trowel becomes a further object of the invention.

What is perceived as a special object of the invention is that of achieving a new method and apparatus for steering a motor-powered trowel machine. Such method and apparatus of the invention is based on a system in which the tilt of individual blades in a rotor assembly progressively changes during each rotation of the assembly and is controlled as to where in the circle and to what degree the tilting takes place and with such controlled blade tilt being used as a means for controlling the direction in which the machine is steered.

The recited and other objects which will become apparent as the description proceeds thus become the objects of the invention.

DISCLOSURE OF INVENTION

A motor-powered walking type rotary trowel is illustrated in the preferred embodiment as employing two sets of trowel blades each having a set of four trowel blades mounted on radially-arranged arms. Power is supplied by a gasoline engine which in turn powers two hydraulic motors. Each hydraulic motor drive shaft is coupled to one set of trowel blades thereby enabling each set of blades to be rotated by its own hydraulic drive motor around the axis of the respective drive shaft. The two sets of trowel blades counter-rotate and have intersecting circular troweling areas. Circular ring members located above the outer ends of each set of blades rotate with the blades and are provided with gear teeth members with the gear teeth members above one set of blades loosely engaging the gear teeth members on the other set of blades. This somewhat loose gear teeth engagement allows each hydraulic motor to absorb some shock without transferring the stress immediately to the other set of blades, particularly when at the time the shock is experienced the teeth are not in tight engagement. However, the gear teeth above one set of blades can readily engage the gear teeth above the other set of blades when one set tends to rotate faster than the other set so as to maintain the sets of blades synchronized to compensate for one set of blades momentarily being loaded differently from the other set of blades.

The blades prior to being used for smoothing concrete can be placed in a relatively-flat or near-flat position for floating or tilted so that the weight of the trowel can be supported on the trowel blade edges for finishing. In addition to being able to position the blades for floating or finishing the invention also provides a mechanism controlled by raising and lowering the handle which provides the ability to progressively change the amount of individual blade tilt as the blade rotates in reference to the location of the blade in the troweling circle. Such mechanism enables the operator to steer the trowel machine in one direction substantially transverse to the longitudinal axis of the machine by raising the handle and steering the machine in an opposite direction substantially transverse to the longitudinal axis of the machine by lowering the handle. The requirement to tilt the axes of the entire rotor assemblies as in the prior art has been eliminated. There has thus been provided what is believed to be a significantly improved method and means for steering a power-operated trowel as next described in more detail in reference to the drawings and following description.

BEST MODE FOR CARRYING OUT THE INVENTION

Figure 1:
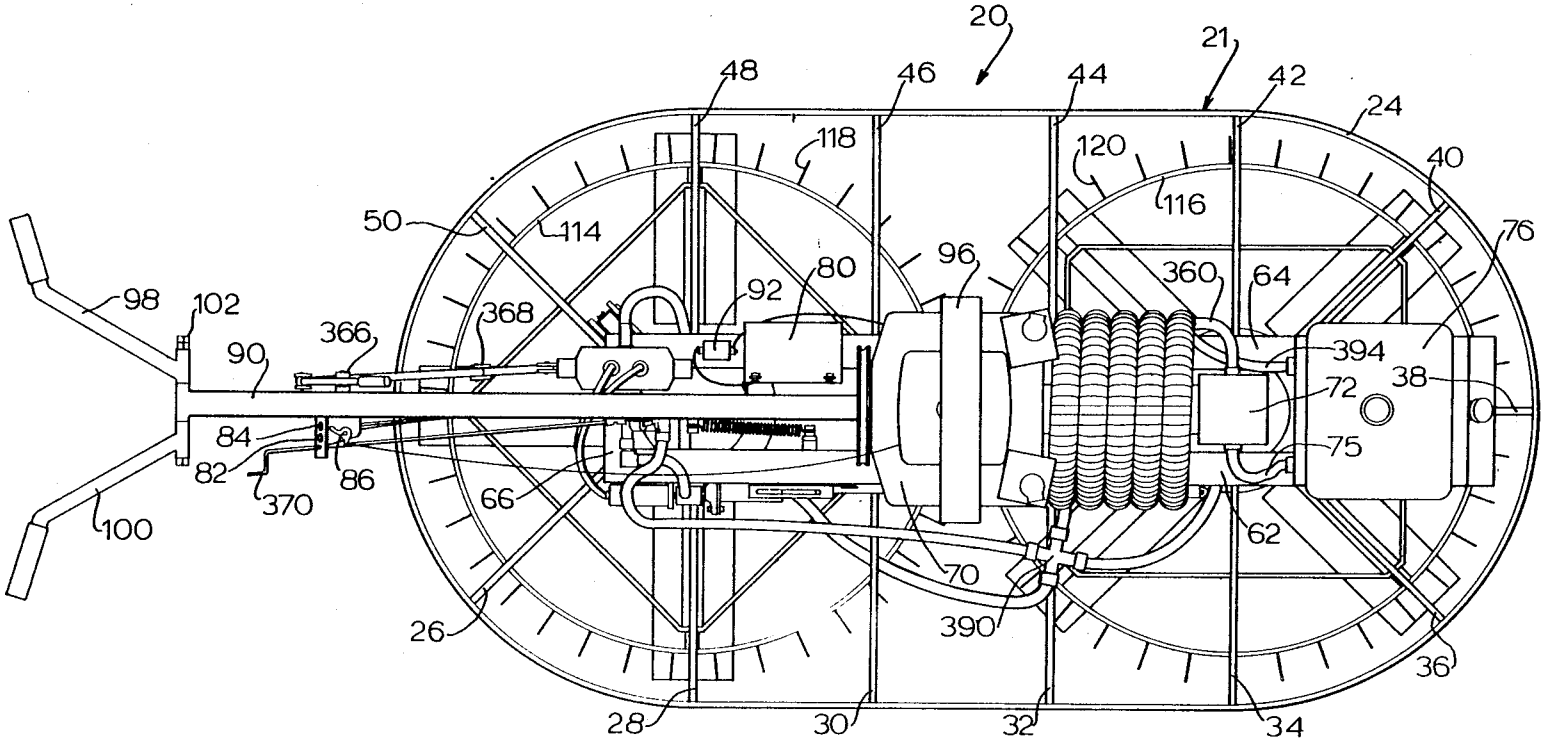
FIG. 1 is a top plan view of a troweling machine in accordance with the invention.
Figure 2:
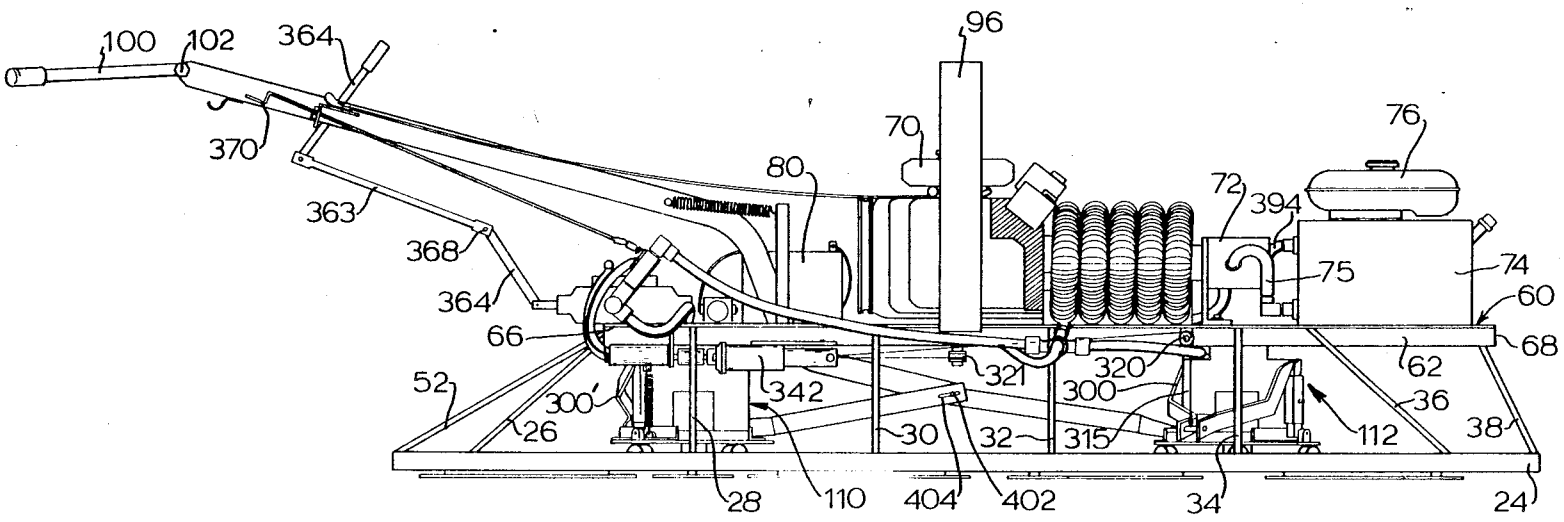
FIG. 2 is side elevation view of the troweling machine of FIG. 1.

Making reference to the drawings, the trowel machine 20 of the invention primarily of metal construction incorporates a metal frame 21 made up of a somewhat elliptical shaped closed base frame or guard rail 24 with suitably secured uprights 26, 28, 30, 32, 34, 36, 38, 40, 42, 44, 46, 48, 50 and 52. The uprights are in turn appended to an upper, elongated, rectangular frame 60 having angle iron side rails 62,64 and end rails 66,68.

Upper frame 60 supports a gasoline engine 70, the primary source of power, which drives a hydraulic pump 72 connected to oil reservoir 74 through line 75. Upper frame 60 supports reservoir 74 mounting gasoline tank 76 having a fuel line connected to engine 70. A battery 80 for starting engine 70 is supported on upper frame 60 adjacent to the engine 70. A conventional start switch 82, "kill" switch 84 and carburetor control 86 are suitably mounted on handle 90. Starter switch 92 is mounted on upper frame 60 with all such conventional components having suitable electrical and mechanical connections not shown in detail. A centrally located loop support 96 secured to upper frame 60 allows the entire trowel machine 20 to be lifted with a crane lift or the like. Handle 90 mounts oppositely, outwardly-angled handlebars 98,100 which are fixedly secured at a selected angle by means of the adjusting nut/bolt arrangement 102.

Figure 3:
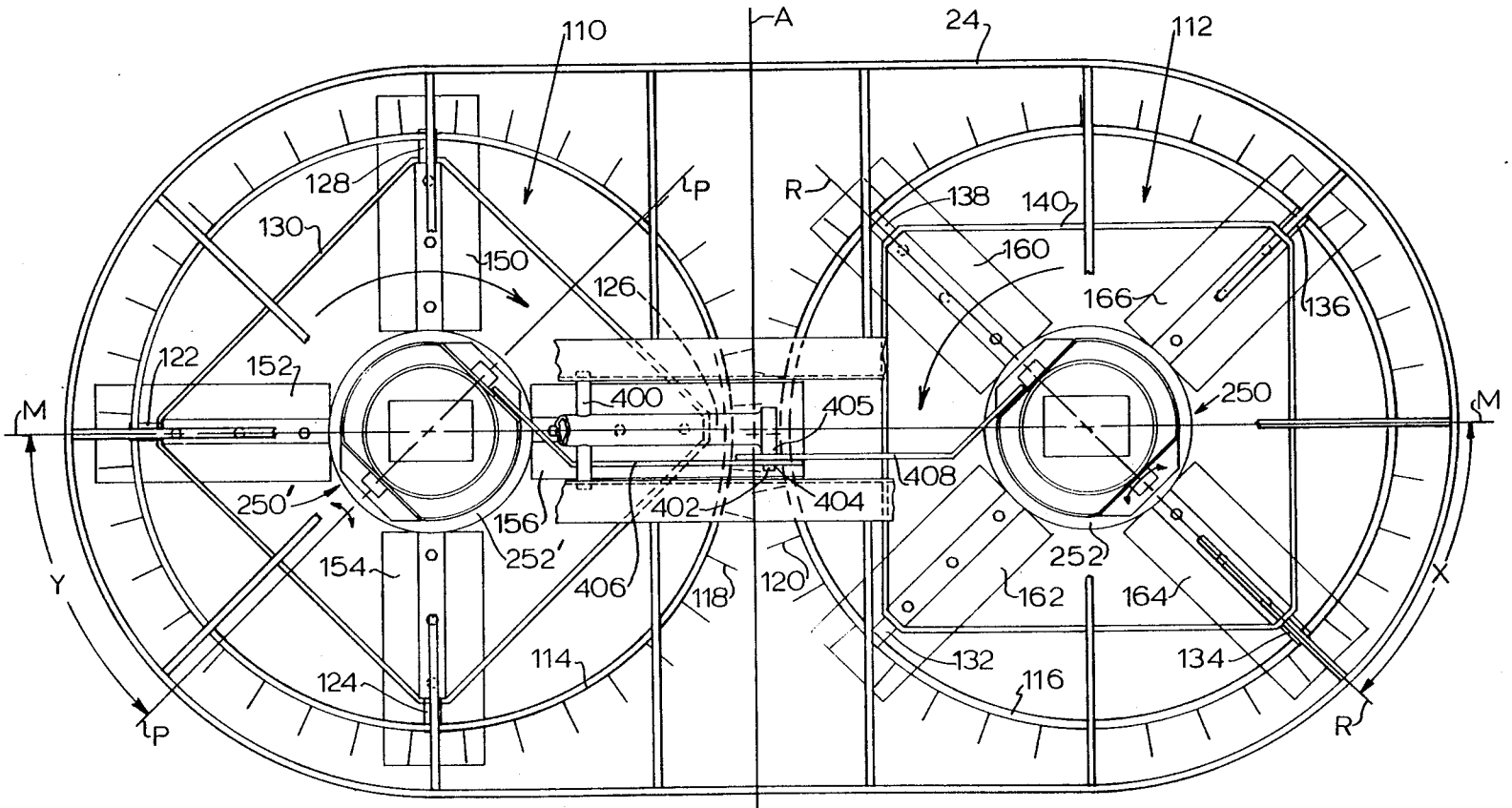
FIG. 3 is a top plan view of the troweling machine primarily illustrating the trowel blade configuration with major components and details removed for purposes of illustration.

Trowel machine 20 includes a pair of trowel rotor assemblies 110, 112 and may be referred to as a twin, dual or double trowel. The respective sets of trowel blades are supported beneath respective gear rings 114,116 having loosely interengaging teeth 118,120 as best seen in FIG. 3. The respective gear ring 114 is supported in the case of rotor assembly 110 by brackets 122, 124, 126, 128 (FIG. 3) which are in turn secured to a substantially-square, inner brace frame 130. In a similar manner, gear ring 116 is supported by brackets 132, 134, 136, 138 secured to the substantially-square, inner brace frame 140.

Rotor assembly 110 includes a set of four blades 150, 152, 154, 156 and rotor assembly 112 includes a set of four blades 160, 162, 164, 166 and which are generally of the same construction. Rotor assembly 112 is used for reference. Parts of rotor assembly 110 similar to those of rotor assembly 112 are indicated by the same number with a prime mark. As later explained, each of the blades tilts about the axis of a shaft 167 to which the blade is secured. Making reference next to FIGS. 5 and 9 and using rotor assembly 112 and blade 162 as an example, it will be noted that blade 162 is secured to a bar 165 by means of bolts, not shown, which in turn is secured to a shaft 167 by means of three bolts 168. Shaft 167 is in turn supported at its outer end by a bolt 170 passing through a downwardly extending portion of bracket 132 and through an oversized hole, not shown, formed in inner frame 140. Thus, one end of the assembly made up of blade 162, bar 165, and shaft 167 is able to rotate around the axis of shaft 167 passing through bolt 170 while the opposite end of shaft 167 rotates in tube member 192.

Figure 5:
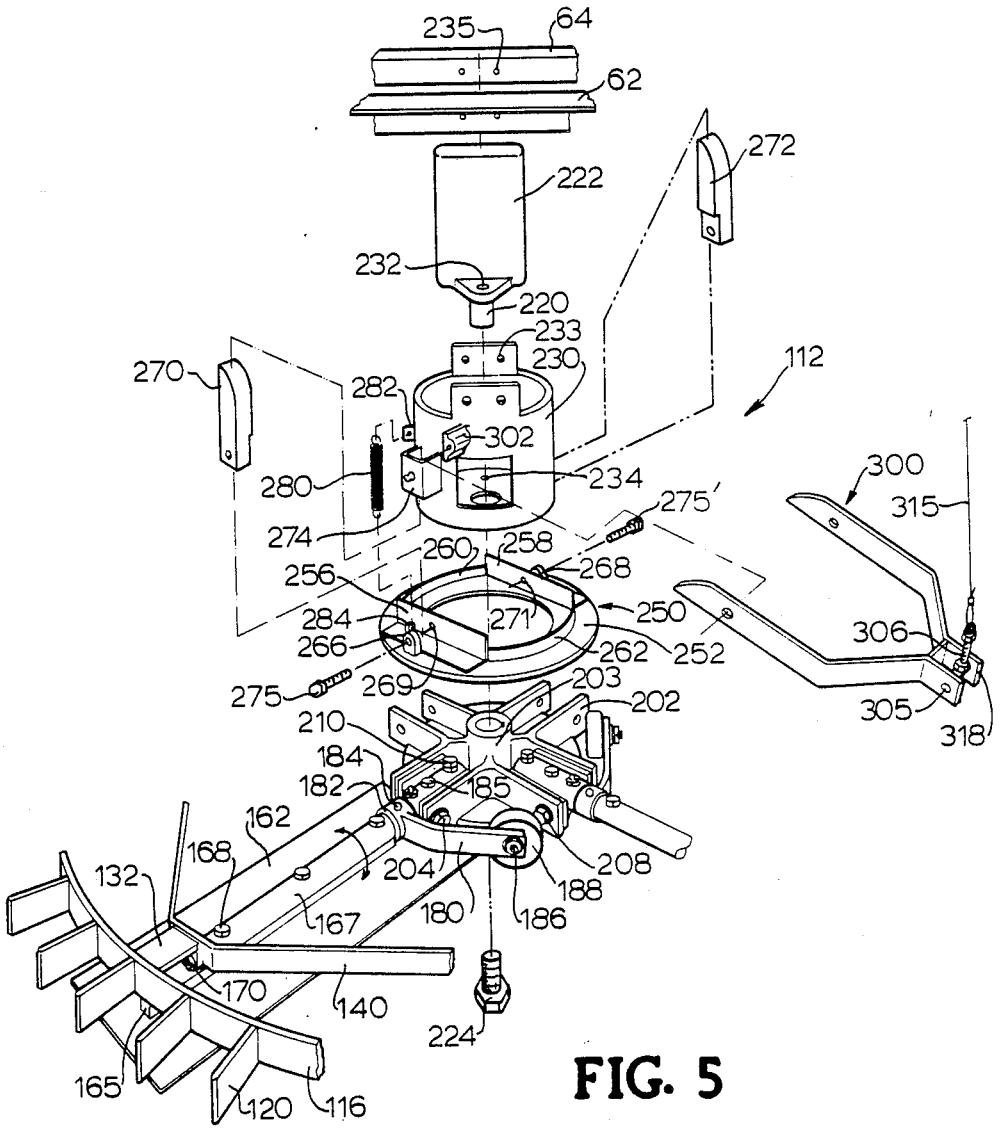
FIG. 5 is an exploded view of the components of a rotor assembly comprising the drive mechanism and the blade tilting mechanism for one of the sets of trowel blades.
Figure 9:
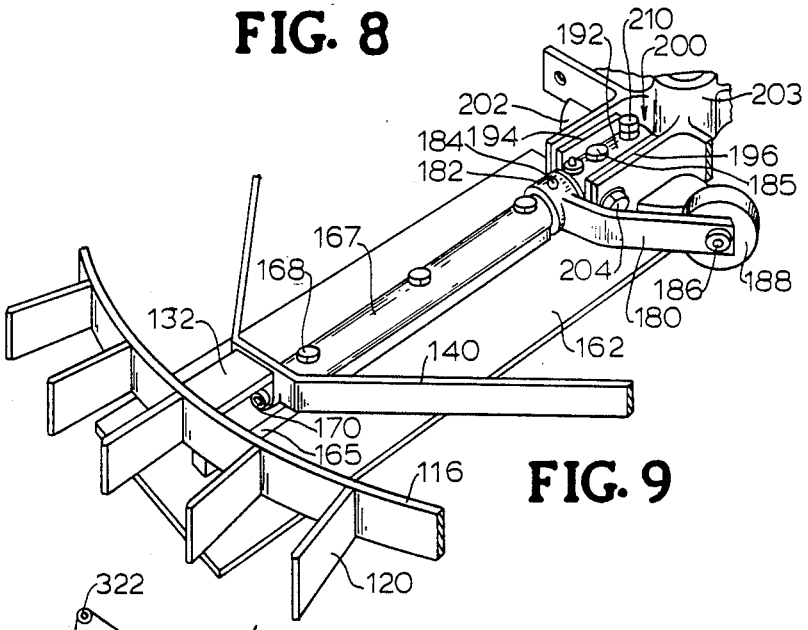
FIG. 9 is a portion of the structure used to mount and regulate the tilt of a trowel blade.

With continuing reference to FIGS. 5 and 9 and continuing to use rotor assembly 112 as an example of the general construction employed in rotor assemblies 110 and 112, it will be noted that an arm member 180 extending radially outwardly from the axis of shaft 167 includes an integral hub portion 182 rigidly secured to shaft 167 by means of a set screw 184. Arm 180 also mounts on a suitable shaft member 186 a roller 188. Thus, it will be seen that the tilt position of blade 162 can be controlled by the position of roller 188 and how such control is effected is later explained.

Figure 6:
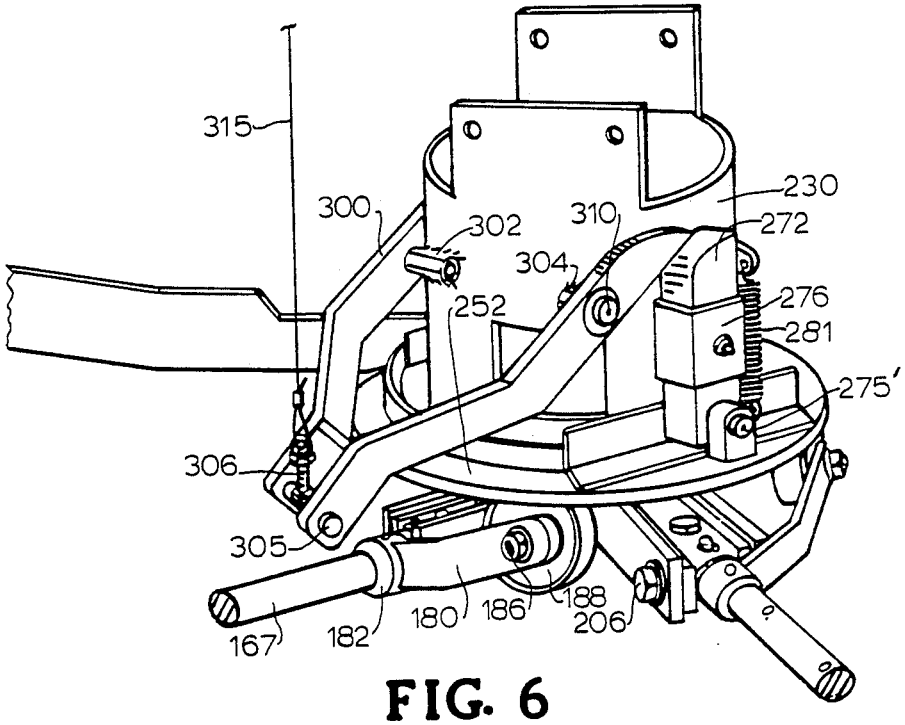
FIG. 6 is a perspective view of a portion of the assembled rotor assembly shown in FIG. 5.

The end of shaft 167 containing slot 190 is rotatably received in the hollow tube 192 welded to and between a pair of plates 194, 196. A bolt 185 is received by slot 190 to retain shaft 166 in tube 192. The plate-tube assembly comprising tube 192 and plates 194, 196 is loosely received in a receptacle portion 200 which is one of four such receptacles formed in the rotor drive base 202. The tube-plate assembly comprising tube member 192 and plates 194, 196 is retained by a pair of oppositely positioned screws 204, 206 one of which is seen in FIG. 5 and a comparable opposite one of which labeled 206 is seen in FIG. 6. The mentioned tube-plate assembly comprising tube member 192 and welded on plates 194, 196 pivots on the mentioned screws 204, 206 and is positioned by means of an adjusting screw 210. By use of adjusting screw 110, the axis of shaft 167 can be pivoted around the horizontal axis passing through screws 204, 206 thus accommodating to shaft wear, slight differences in manufactured sizes, and the like.

Continuing to use FIGS. 5 and 9 and rotor assembly 112 for reference, the rotor drive base 202 receives the drive shaft 220 of hydraulic motor 222 in hub 203 and is secured by means of a bolt 224 passing through the bottom end of the drive shaft 220 of hydraulic motor 222. Hydraulic motor 222 is in turn rigidly secured within a motor casing 230 by means of bolts, not shown, passing through the respective pair of motor mount holes 232 and mating pair of motor casing holes 234 only one of which is shown in FIG. 5. Casing 230 is in turn bolted to the respective side rail members 62, 64 by means of bolts, not shown utilizing holes 233, 235.

Motor casing 230 passes through an integral annular plate assembly 250 comprising an annular bearing plate 252, angle pieces 256, 258, upstanding rims 260, 262 and a pair of pivot blocks 266, 268. Rollers 188 roll on the underside of bearing plate 252. Pivot blocks 266, 268 connect respectively to a pair of plungers 270, 272 received by oppositely disposed guides 274, 276. Bolt 275 passes through the respective bearing block 266, plunger 270 and angle piece 256. In a comparable manner, the opposite plunger 272 passes through guide 276 and is secured to bearing block 268 and angle piece 258 by bolt 275'. The later referenced axis R—R (FIG. 3) passes through bolts 275 and 275'. Thus, plate assembly 250 moves up and down on motor casing 230 with the two plungers 270, 272 to which assembly 250 is connected. Also to be noted is that bearing plate 252' can be made to pivot around axis P—P (FIG. 3) and bearing plate 252 can be made to pivot around axis R—R. Thus, each bearing plate 252' and 252 can both be adjusted vertically and tilted.

A pair of springs 280, 281 connected between spring holders 282 and 284 tends to pull plate assembly 250 and plungers 270, 272 upwardly. The respective plungers 270, 272 are vertically positioned by means of a U-shaped arm or fork member 300 (FIG. 5) pivoted on opposed supports 302, 304 formed on casing 230 and secured by appropriate bolts 310. Making reference to FIG. 6, it will be seen that when cable 315, attached to pin 305 through adjusting screw 306, is pulled upwardly arm 300 tends to push the pair of plungers 270, 272 down and thus tends to push the bearing plate 252 down thereby limiting the respective blade tilting arms 180 to positions where the respective blades, such as blade 162, are held in a relatively tilted or finishing position. However, it will also be noticed that when cable 315 is released, the respective plungers 270, 272 tend to rise and thus bearing plate 252 tends to be elevated allowing rollers 188 to return the troweling blades to a relatively flat or float position.

Figure 7:
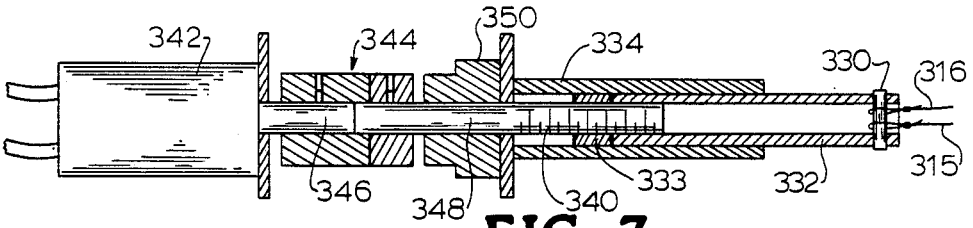
FIG. 7 is a partial section view of the hydraulic control screw mechanism employed to regulate the normal tilt of the blades appropriate to floating or finishing.
Figure 8:
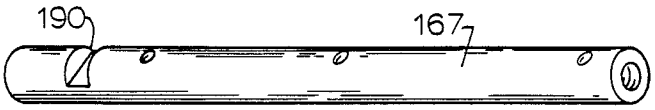
FIG. 8 is a perspective view of a shaft used to mount one of the trowel blades.
Figure 10:
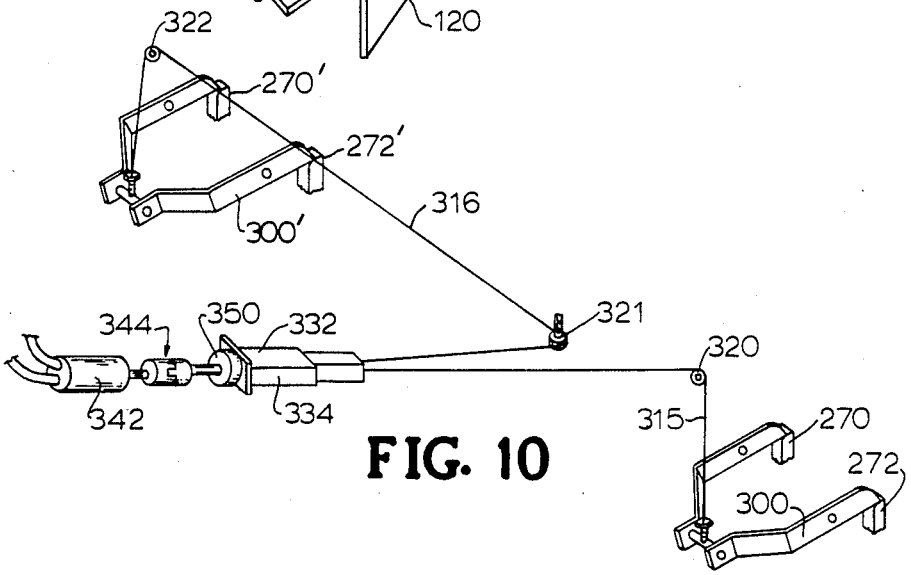
FIG. 10 is a somewhat schematic diagram illustrating how the normal blade tilt is regulated.

As best illustrated in FIGS. 7 and 10, the respective fork 300 for rotor assembly 112 and fork 300' for rotor assembly 110 are controlled by the respective cables 315, 316. Cables 315, 316 are trained over appropriately positioned rollers 320, 321 and 322 as schematically illustrated in FIG. 10. The pull end of cables 315, 316 are connected to a pin 330 mounted in the outer end of a hollow tube 332 mounted to slide in a telescoping relation in an outer tube 334. Tube 332 mounts an internally-threaded nut 333 which receives a threaded shaft 340 driven by a reversible hydraulic motor 342 having a drive shaft 346 connected to threaded shaft 348 through a Lovejoy-type coupling 344 and mounted in a bearing 350. It will be understood tha2t as the reversible hydraulic motor 342 rotates in one direction or the other, cables 315, 316 will be pulled in a corresponding direction and thus will either raise or lower the corresponding fork arms 300, 300' and thus will move the individual trowel blades to either a relatively tilted or relatively flat position corresponding to the position of the respectives forks 300, 300'.

Figure 4:
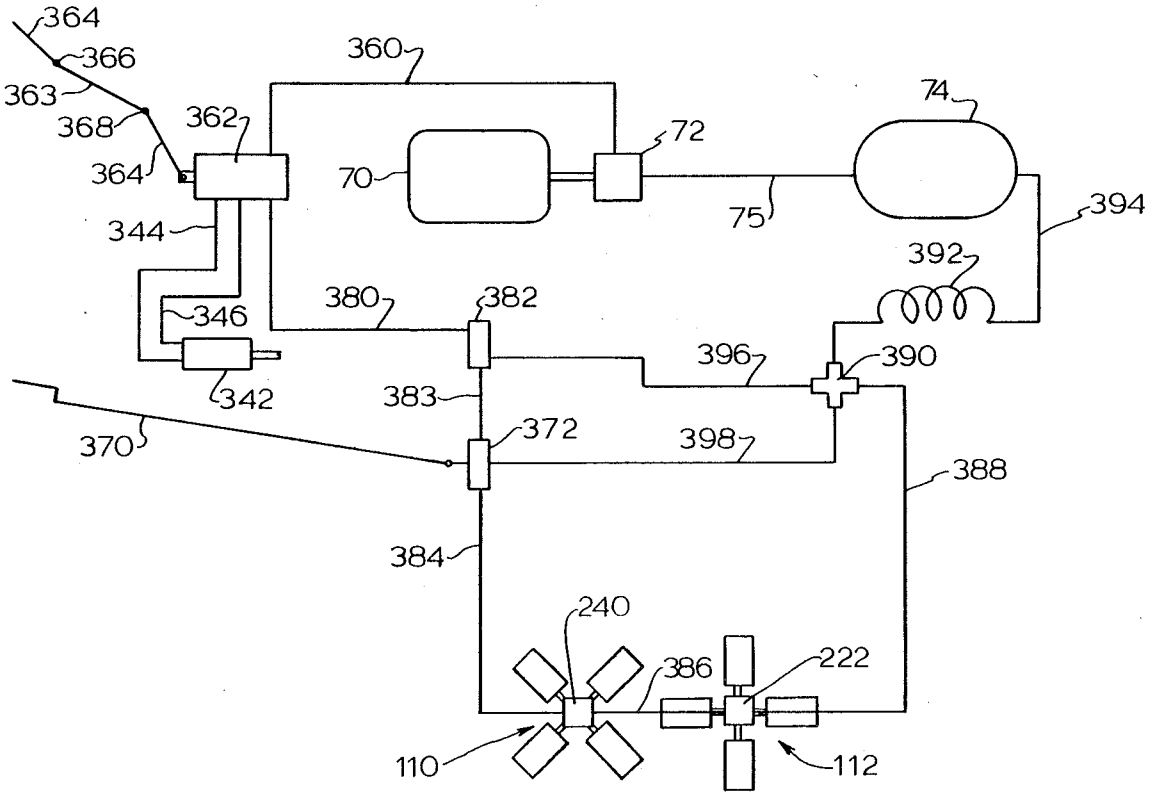
FIG. 4 is a schematic diagram of the hydraulic system employed with the troweling machine of the invention.

As illustrated in FIG. 4, engine 70 drives pump 72 which creates pressure in line 360 connected to the intake side of valve 362 controlled by handle 364 pivotally mounted on shaft 366 and connected to valve 362 through links 363, 364 and a pivotal joint 368. Valve 362 comprises a 4-way, double-action, single-spool, control valve such as valve model CVA-200 made by Energy Manufacturing Company of Monticello, Ia. In order to tilt the blades to a selected position, handle 364 is moved to a selected position which causes pressurized oil to be diverted to hydraulic motor 342 and causes motor 342 connected through hydraulic lines 344, 346 to rotate in a corresponding direction thus tending to lift or lower control forks 300, 300' and thereby tending to raise or lower the elevation of plate assemblies 250, 250'. The elevation of plate assemblies 250, 250' in turn controls the position of bearing plates 252, 252' and the position of rollers 188 and thus the tilt position of the troweling blades in both sets.

Referring again to FIG. 4 and also to FIG. 1, a crank-type control handle 370 is mounted to revolve and thereby position another control valve 372. Valve 372 is of the rotatable ball type having a ball with a passage. In one position, the ball is rotated to close the passage and in another position, the pressurized oil passes through the passage with the valve being effectively open. Valve 372, when open, receives the pressurized oil in line 380 through a pressure relief valve 382 and line 383 and directs such pressurized oil through lines 384, 386 and 388 to drive the series-connected hydraulic motors 240, 222 for driving the trowel blade sets forming part of the rotor assemblies 110, 112. The speed of motors 240, 222 can be controlled by the amount valve 372 is opened. The pressurized oil returns through a four-way connector 390, a cooling coil 392 and return line 394 to reservoir 74. Excess pressure is relieved through line 396. Line 398 allows the pressurized oil to bypass the hydraulic motors 240, 222 when valve 372 is fully closed.

It should be understood that when both of the rotating blade sets 110, 112 are operated with the blades set flat, i.e., without tilt, the machine 20 essentially rests in place. Also, the machine 20 will essentially rest in place when the blades are all tilted to some fixed amount which does not change and remains fixed as to all blades during each rotation. It is only when the blades in each set are caused to progressively change their amount of tilt during each rotation that blade reaction forces are developed to cause the machine to move generally along axis A—A laterally to the longitudinal axis M—M of the machine. This action is next explained.

Figure 11:
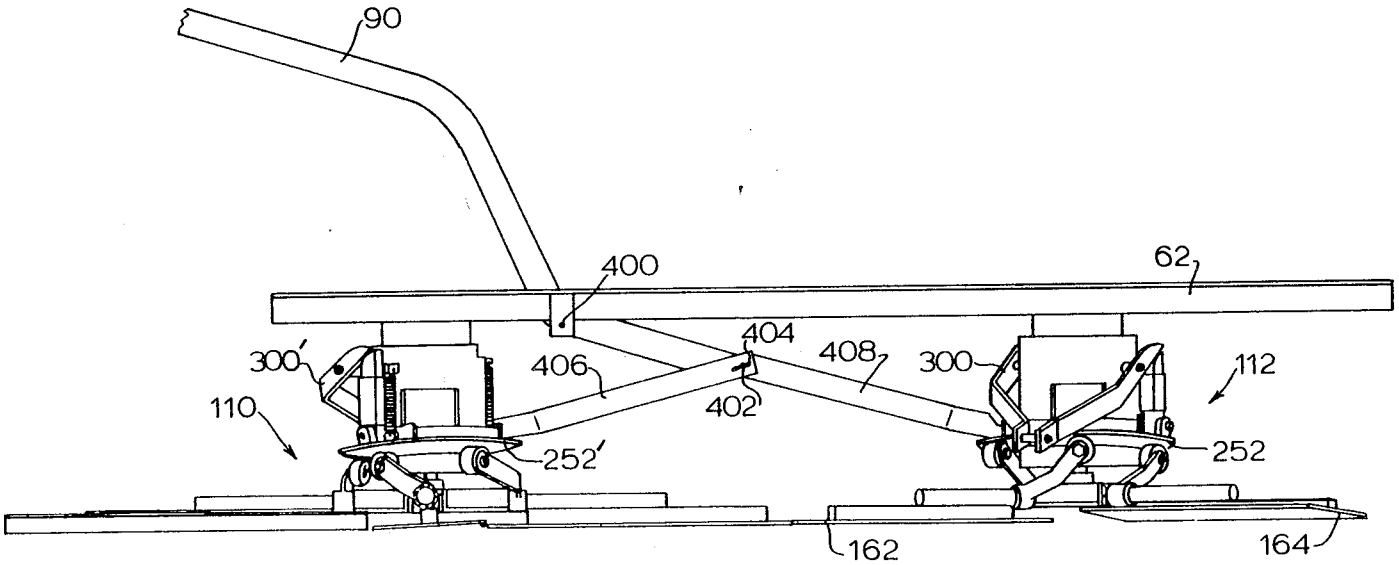
FIG. 11 illustrates the handle lowered so as to cause the individual blades to progressively change their respective angles of tilt as they rotate in the troweling circle as a means of steering the invention trowel machine in one direction substantially transverse to the longitudinal axis of the machine frame.
Figure 12:
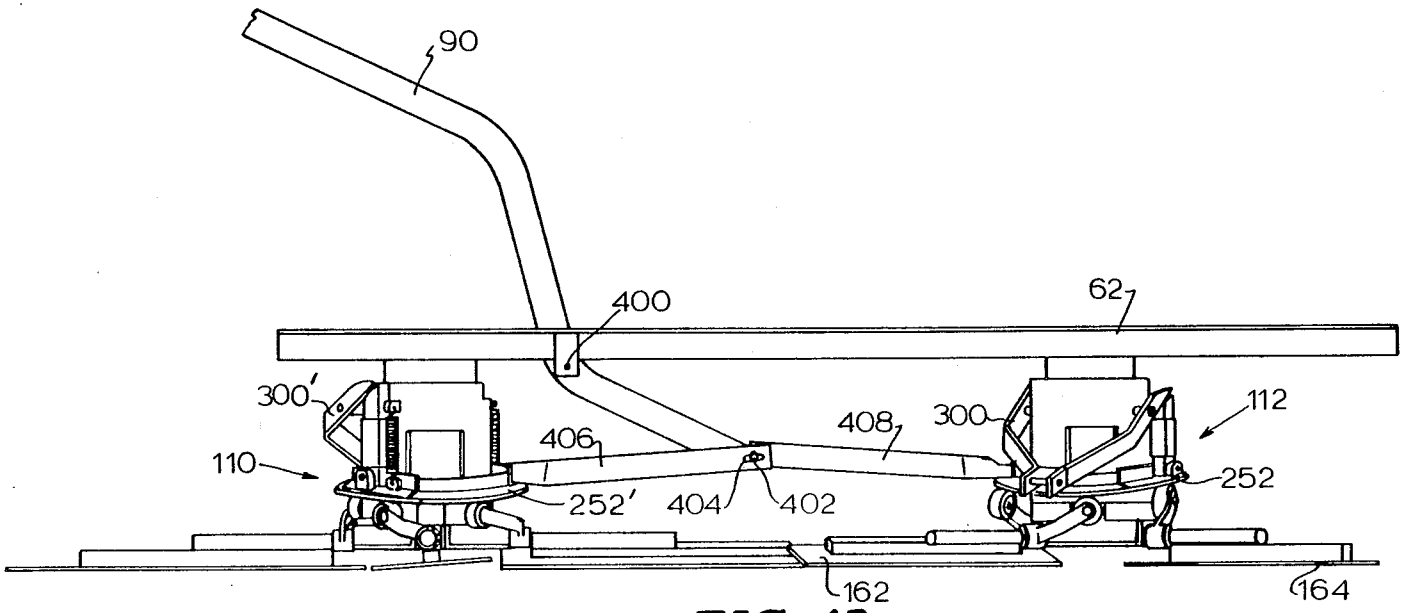
FIG. 12 is a view similar to FIG. 11 but with the handle raised so as to cause the individual blades to progressively change their respective angles of tilt as they rotate in the troweling circle but to a different degree and location from that associated with FIG. 11 so as to steer the trowel machine in an opposite direction from that related to FIG. 11.

Progressive changing of blade tilt during each rotation is accomplished by raising or lowering of handle 90 around pivot bolt 400. Handle 90 at its lower end mounts a pin 402 which engages slots 404, 405 formed in the ends of the respective pivotal arms 406, 408. Pivotal arm 406 is fixedly secured by welding, or the like, to the bearing plate 252' of rotor assembly 110 (FIGS. 11 and 12). Pivotal arm 408 is fixedly secured to bearing plate 252 of rotor assembly 112. Thus, pivoting of pivotal arms 406, 408 upwardly causes the portions of bearing plates 252' and 252 secured to the respective arms 406, 408 to pivot upwardly and the opposite portions downwardly as viewed in FIG. 11. Pivoting of pivotal arms 406, 408 downwardly causes the same portions of bearing plates 252', 252 attached to arms 406, 408 to tilt downwardly and the opposite portions upwardly as viewed in FIG. 12. Tilting of the respective bearing plates 252', 252 causes the respective rollers 188 (FIG. 9) to move the respective arms 180 (FIG. 9) such that the angle of tilt for each blade progressively changes during each rotation.

Since the entire weight of the machine 20 rests on the two sets of troweling blades in the respective rotor assemblies 110, 112, it will be readily seen that as each individual roller 188 progresses on the underside of each respective bearing plate 252 or 252' during each rotation, the blade tilt will be greatest on the low side of the bearing plate and least on the high side of the bearing plate. Note, for example, the difference in blade tilt between blades 164 and 162 in FIG. 11 when handle 90 is raised and between blades 164 and 162 in FIG. 12 when handle 90 is lowered. What is also to be observed is that the axis of rotation P—P (FIG. 3) of the bearing plate 252' for the troweling blades of rotor assembly 110 intersects the longitudinal axis M—M of the machine 20 and is substantially at a right angle to axis of rotation R—R of bearing plate 252 for the trowel blades of rotor assembly 112 which also intersects the longitudinal axis M—M of machine 20. The illustrated included angle X in FIG. 3 between axis M-M and axis R—R approximates 45 degrees as does the included angle Y between axis M—M and axis P—P. It is this offset axis arrangement for bearing plates 252, 252' which has been found particularly advantageous for achieving the desired lateral motion.

In summary, at least the following advantages are achieved:

1. A dual rotary trowel is provided which operates like a single rotary trowel thus eliminating any need to retrain the operator.
2. A dual rotary trowel is provided which can be operated with one hand.
3. A relatively small handle motion is translated into a relatively large and rapid lateral motion.
4. The invention machine can be made light enough in weight to effectively "float" with wide blades before the concrete is fully dry to break up the crust preparatory to troweling.
5. During progressive changing of blade tilt for steering the tilt of each blade on its own blade support axis is independent of the tilt of all other blades.
6. Preparatory to imposing progressive changing of tilt, a uniform amount of blade tilt can be imposed simultaneously on all blades in each set by raising or lowering the bearing plate while holding the bearing plate relatively flat or horizontal.
7. The cushioning effect of a hydraulic motor drive for both sets of trowel blades is provided.

What is claimed is:

1. A concrete troweling machine comprising:

(a) a frame structure including:
  (i) an upper elongated frame; and
  (ii) a guard rail at the base of the machine depending from said upper elongated frame;

(b) a pair of hydraulic motors secured to said upper elongated frame at spaced apart positions and having vertical drive shafts extending therefrom;

(c) a pair of sets of troweling blade assemblies, each of said assemblies having a set of troweling blades supporting the machine, said troweling blades each being tiltable about its own longitudinal support axis and extending radially outward from a drive member on which said set of troweling blades is mounted and which is connected to be independently driven by a respective said hydraulic motor drive shaft, said sets of troweling blades being arranged such that the circular troweling areas of the sets intersect and the blades of the sets intermesh as they rotate, said guard rail extending around said sets of troweling blades;

(d) an engine, a hydraulic pump driven by said engine and an associated oil reservoir and hydraulic control all mounted on said upper frame structure and providing means for energizing and controlling said motors enabling said drive shafts to be caused to stop or to be selectively driven at a selected speed to cause said sets of troweling blades to be rotated in opposite directions;

(e) each said troweling blade being secured to a horizontal shaft rotatably mounted in the said drive member from which the troweling blade extends;

(f) said horizontal shaft being positioned by means of a lever arm fixed at one end to said horizontal shaft and at the opposite end mounting a roller;

(g) each said assembly including means for adjusting the position of each said roller enabling the tilt position of each of the troweling blades to be set corresponding to the position of said adjusting means; and (h) means for progressively changing the tilt of the individual blades, each about its own longitudinal support axis in each said set of troweling blades during each rotation thereof while maintaining the axis of rotation of said vertical drive shafts fixed to selectively generate blade reactive forces for propelling the machine in opposite directions along a path of movement extending generally at right angles to the longitudinal axis of said elongated frame.

2. A concrete troweling machine as claimed in claim 1 wherein said adjusting means includes means contacting each said roller and operative to progressively change the tilt of the blades in each set during rotation thereof.

3. A concrete troweling machine as claimed in claim 1 in which for each said assembly:

(a) said adjusting means includes a bearing plate located above the drive member;

(b) the roller for each troweling blade bears against and rolls on the underside of said bearing plate;

(c) the position of said bearing plate controls the position of said rollers and thereby the tilt position of said troweling blades; and (d) said bearing plate is mounted on said assembly for both tilting and vertical movement thereby enabling said troweling blades to rotate at a selected fixed amount of tilt or at a progressively changing amount of tilt during each rotation thereof.

4. A concrete troweling machine as claimed in claim 3 in (a) said bearing plate is mounted on a pair of remotely positionable vertically slidable support members located on opposite sides of said drive member and to tilt on an axis passing through said support members; and (b) a pivotal handle is positioned at one end of said upper elongated frame with a linkage connection to said bearing plates enabling said handle by raising and lowering to control tilting of said bearing plates and thereby control movement of the machine in opposite directions along a path of movement extending generally perpendicular to the longitudinal axis of said upper elongated frame structure.

5. A cement troweling machine as claimed in claim 4 wherein said support members are mounted such that the axis through said support members intersects at a non-perpendicular angle the longitudinal axis through said upper elongated frame structure.

6. concrete troweling machine, comprising:

(a) an elongated frame;

(b) a handle mounted on and extending outwardly from one end of said frame;

(c) a pair of troweling blade assemblies having:

(i) sets of troweling blades supporting the machine with the circular troweling areas of the blades intersecting and the blades of the sets arranged to intermesh as they rotate;

(ii) a trowel blade drive support for each set of blades, said blades of each set being mounted on said drive support such that each blade is able to tilt on a respective longitudinal axis extending through a shaft mounting the blade; and (iii) rotor shafts rotatable on fixed vertical axes connected to drive said trowel blade drive supports and depending from said elongated frame at lengthwise spaced positions on the longitudinal axis of said frame;

(d) means for driving said rotor shafts to rotate said sets of troweling blades in opposite directions;

(e) blade tilt control means operatively associated with said sets of troweling blades for tilting and progressively changing the tilt of each blade in each set during each rotation thereof in a selected manner effective to generate blade reactive forces for propelling the machine along a path generally at a right angle to the longitudianl axis of said frame and in either of selected opposite directions;

(f) said blade tilt control means including:

(i) first independently controllable means for simultaneously establishing the tilt of all the blades in both sets of blades in some uniform amount; and (ii) second independently controllable means for simultaneously and progressively changing said uniform amount of tilt in both sets of blades in a manner selected to cause said machine to be propelled in a selected one of opposite directions.

7. A concrete troweling machine as claimed in claim 6 in which said means for driving said drive shafts comprise a pair of hydraulic motors fixedly secured to said frame.

8. A concrete troweling machine as claimed in claim 6 in which:

(a) said first means includes a remotely-controlled, vertically-positioned bearing plate surrounding the rotor shaft of each said troweling blade assembly;

(b) the tilt of each said trowel blade is controlled by a lever arm extending radially from the longitudinal axis of rotation of a shaft mounting said trowel blade and mounting a roller bearing against the underside of said bearing plate;

(c) each said bearing plate is mounted for pivoting about a horizontal axis passing through the rotor shaft about which the bearing plate is mounted;

(d) said second means includes:

(i) a pair of linkages separately fixedly secured to each said bearing plate; and (ii) means pivotally connecting a lower end of said handle to outer ends of said pair of linkages; and (e) said handle is pivotally mounted on said frame enabling raising and lowering of said handle to tilt both said bearing plates simultaneously in either of two corresponding opposite directions of tilt to thereby control the propelling of said machine in one or the other of selected opposite directions.

9. A concrete troweling machine, comprising:

(a) a frame (b) troweling blade assemblies mounted on the frame and having:

(i) sets of troweling blades supporting the machine;

(ii) a trowel blade drive support for each set of blades, said blades of each set being mounted on said drive support such that each blade is able to tilt on a respective longitudinal axis extending lengthwise of the blade; and (iii) rotor shafts rotatable on fixed vertical axes connected to drive said trowel blade drive supports and depending from said frame at spaced positions on said frame;

(c) means for driving said rotor shafts to rotate said sets of troweling blades; and (d) blade tilt control means operatively associated with said sets of troweling blades for selectively tilting and progressively changing the tilt of each blade in each set during each rotation thereof in a selected manner effective to generate blade reactive forces for propelling the machine along a selected path, said blade tilt control means including:

(i) first independently controllable means for simultaneously establishing the tilt of all the blades in all said sets of blades in some uniform amount; and (ii) second independently controllable means for simultaneously and progressively changing the amount of tilt in said sets of blades during rotation thereof in a manner selected to cause said machine to be propelled in a selected one of opposite directions.

10. A concrete troweling machine comprising:

(a) a frame stucture including:

(i) an upper elongated frame; and (ii) a guard rail at the base of the machine depending from said upper elongated frame;

(b) a pair of hydraulic motors secured to said upper elongated frame at spaced apart positions and having vertical drive shafts extending therefrom;

(c) a pair of sets of troweling blade assemblies, each of said assemblies having a set of troweling blades supporting the machine, said troweling blades each being tiltable about its own longitudinal support axis and extending radially outward from a drive member on which said set of troweling blades is mounted and which is connected to be independently driven by a respective said hydraulic motor drive shaft, said sets of troweling blades being arranged such that the circular troweling areas of the sets intersect and the blades of the sets intermesh as they rotate, each said set of troweling blades having an annular gear engaged with an annular gear of the other set, said guard rail extending around said sets of troweling blades;

(d) an engine, a hydraulic pump driven by said engine and an associated oil resdrvoir and hydraulic control all mounted on said upper frame structure and providing means for energizing and controlling said motors enabling said drive shafts to be caused to stop or to be selectively driven at a selected speed to cause said sets of troweling blades to be rotated in opposite directions; and (e) means for progressively changing the tilt of the individial blades, each about its own longitudinal support axis in each said set of troweling blades during each rotation thereof while maintaining the axis of rotation of said vertical drive shafts fixed to selectively generate blade reactive forces for propelling the machine in opposite directions along a path of movement extending generally at right angles to the longitudinal axis of said elongated frame.

11. A concrete troweling machine, comprising:

(a) a frame;

(b) troweling blade assemblies mounted on the frame and having:

(i) sets of troweling blades supporting the machine;

(ii) a trowel blade drive support for each set of blades, said blades of each set being mounted on said drive support such that each blade is able to tilt on a respective longitudinal axis extending lengthwise of the blade; and (iii) rotor shafts rotatable on fixed vertical axes connected to drive said trowel blade drive supports and depending from said frame at spaced positions on said frame;

(c) means for driving said rotor shafts to rotate said sets of troweling blades; and (d) independently controllable means for simultaneously and progressively changing the amount of tilt of each blade in each of said sets of blades during each rotation thereof in a manner effective to generate blade reactive forces for propelling the machine along a selected path.

* * * * *

UNITED STATES PATENT AND TRADEMARK OFFICE

CERTIFICATE OF CORRECTION

PATENT NO. : 4,676,691

DATED : June 30, 1987

INVENTOR(S) : Donald R. Morrison

It is certified that error appears in the above-identified patent and that said Letters Patent is hereby corrected as shown below:

Column 6, line 64 correct "tha2t" to read --that--.

Column 9, line 57, insert --which:-- after "in".

Column 10, line 9 insert --A-- before "concrete".

Column 12, line 12 correct "resdrvoir" to read --reservoir--.

Signed and Sealed this

Third Day of November, 1987

*Attest:*

*Attesting Officer*

DONALD J. QUIGG

*Commissioner of Patents and Trademarks*